US011794317B2

(12) United States Patent
Rubino et al.

(10) Patent No.: US 11,794,317 B2
(45) Date of Patent: Oct. 24, 2023

(54) MULTIPURPOSE TOOL

(71) Applicant: Sensible Products, Inc., Chicago, IL (US)

(72) Inventors: Michael Rubino, Chicago, IL (US); Hermann Fruhm, Pitt Meadows (CA)

(73) Assignee: Sensible Products, Inc., Chicago, IL (US)

( * ) Notice: Subject to any disclaimer, the term of this patent is extended or adjusted under 35 U.S.C. 154(b) by 210 days.

(21) Appl. No.: 17/314,599

(22) Filed: May 7, 2021

(65) Prior Publication Data

US 2022/0355447 A1 Nov. 10, 2022

(51) Int. Cl.

| | |
|---|---|
| ***B25B 23/00*** | (2006.01) |
| ***B25F 1/02*** | (2006.01) |
| ***B25G 1/08*** | (2006.01) |

(52) U.S. Cl.

CPC ..... *B25B 23/0035* (2013.01); *B25F 1/02* (2013.01); *B25G 1/085* (2013.01)

(58) Field of Classification Search

CPC ... B25B 15/004; B25B 15/005; B25B 15/007; B25B 23/0042; B25B 23/0035; B25B 13/56; B25B 13/102; B25B 13/06; B25B 15/02; B25B 15/04; B25B 23/0021; B25B 13/466; B25G 1/04; B25G 1/043; B25G 1/08; B25G 1/085; B25G 1/06; B25G 1/063; B25G 1/10; B25G 3/18; B25H 3/003

USPC ..... 81/124.5, 177.2, 177.4, 436, 438, 439, 81/437, 490, 58.3, 61, 60

See application file for complete search history.

(56) References Cited

U.S. PATENT DOCUMENTS

| | | | | |
|---|---|---|---|---|
| 19,901 | A | 4/1858 | Aiken | |
| 438,150 | A | 10/1890 | Glover | |
| 463,507 | A | 11/1891 | Goodell et al. | |
| 2,158,728 | A | 5/1939 | Peters | |
| 2,476,762 | A | 7/1949 | Petre et al. | |
| 2,527,492 | A | 10/1950 | Cleary et al. | |
| 2,596,594 | A | 5/1952 | Petre | |
| 2,635,661 | A | 4/1953 | Egan | |
| 2,641,478 | A | 6/1953 | Sigg | |
| 2,759,734 | A | 8/1956 | Velepec | |
| 3,114,401 | A | 12/1963 | Johnson | |
| 3,187,610 | A | 6/1965 | Russman | |
| 3,426,813 | A | 2/1969 | Robertson | |
| 3,455,355 | A | 7/1969 | McLogan et al. | |
| 3,683,984 | A * | 8/1972 | Hull | B25G 1/085 81/436 |
| 4,043,230 | A | 8/1977 | Scrivens | |

(Continued)

*Primary Examiner* — Don M Anderson
*Assistant Examiner* — Jason Khalil Hawkins
(74) *Attorney, Agent, or Firm* — McHale & Slavin, P.A.

(57) ABSTRACT

A multipurpose drive tool having a handle to secure an extension driver between an extended position and a retracted position. The extension driver has a proximal end with a ¼ inch socket extending outwardly for use with a plurality of driver bits, and a distal end socket having a 5/16 inch socket. The drive tool further has a ⅜ inch and 7/16 inch socket secured to the handle, having a base member housing with biasing springs for frictionally engaging the driver bits. The extension driver has grooves that interact with a ball bearings positional placement thereof, and a pin for securing the extension driver in an extended or retracted position.

18 Claims, 3 Drawing Sheets

(56) References Cited

U.S. PATENT DOCUMENTS 4,278,119 A 7/1981 Elmore
4,399,723 A 8/1983 Marleau
4,404,874 A 9/1983 Lieser
4,448,097 A 5/1984 Rocca
4,552,043 A 11/1985 Corona et al.
4,776,246 A 10/1988 Elliston
4,779,493 A 10/1988 White
4,846,042 A 7/1989 Wetty
4,924,733 A * 5/1990 McKenzie ..... B25B 15/02 81/439
5,174,178 A 12/1992 Disston, Jr.
5,228,363 A 7/1993 Corona et al.
5,265,504 A 11/1993 Fruhm
5,337,637 A 8/1994 Bih-Lien
5,450,775 A 9/1995 Kozak
5,603,248 A * 2/1997 Eggert ..... B25B 23/12 81/125
5,782,146 A * 7/1998 Lin ..... B25B 15/04 81/177.4
5,875,692 A * 3/1999 Lin ..... B25G 1/085 81/177.4
5,904,080 A 5/1999 Anderson et al.
5,967,003 A * 10/1999 Lin ..... B25B 15/04 81/58.3
6,151,994 A * 11/2000 Shiao ..... B25B 15/04 81/438
6,305,255 B1 * 10/2001 Wu ..... B25G 1/085 81/439
7,353,734 B1 * 4/2008 Hu ..... B25B 15/04 81/62
3,047,102 A1 11/2011 Gnatz
8,561,507 B2 * 10/2013 Huang ..... B25G 1/085 81/177.4
9,796,070 B2 * 10/2017 Sun ..... B25B 15/02
9,943,947 B2 4/2018 Tseng
2005/0284267 A1 * 12/2005 Liao ..... B25G 1/085 81/177.4
2008/0196562 A1 * 8/2008 Elliston ..... B25B 13/56 81/433
2017/0113331 A1 * 4/2017 Lai ..... B25B 13/56
2022/0379443 A1 * 12/2022 Schneider ..... B25G 1/085

* cited by examiner

MULTIPURPOSE TOOL

CROSS REFERENCE TO RELATED APPLICATIONS

Not Applicable

FEDERALLY SPONSORED RESEARCH OR DEVELOPMENT

Not Applicable

FIELD OF THE INVENTION

The present invention is related to the field of manually operated drive tools; and more particularly, to a multipurpose drive tool having sockets and bit drivers.

BACKGROUND OF THE INVENTION

While conventional tools have a singular purpose, multipurpose tools have found great success in the marketplace by providing tools that are cost effective and space saving. For instance, a conventional screw driver has a shank with a handle attached on one end and a driver, such as a Phillips® cross-head, formed at the opposite end. If standard head is required, a second screw driver is needed. If a hexalobular internal thread, commonly known as a star drive or Torx® head is required, a third screw driver is needed and so forth. The cost of the additional screw drivers and associated storage space required will be higher than a multipurpose screw driver having various driver heads in a single tool.

Most every mechanical device employs fasteners, and an individual will benefit if they have access to a multipurpose tool for tightening or loosening the fasteners. The fastener may be a Phillips® head, a blade head, a hex head, a hexalobular internal drive head or the like. Mechanically minded individuals understand that mechanical fasteners may loosen or need to be removed to access a failure. However, many such instances require a complement of tools that may be difficult to store. For instance, apartments, trucks, automobiles, motorcycles, boats, wave runners, and airplanes are but a few examples where tools are needed should mechanical issues arise but have limited storage space. While having a full tool set would be beneficial, it is simply not practical given the limited storage space. Further, with all the types of fasteners in use, an individual that requires tools is at a great disadvantage unless they have the space for storage. Even if a full tool set is accessible, having a multipurpose tool is still beneficial as it can eliminate the need for accessing multiple tools.

Multipurpose tools are known in the industry. U.S. Pat. No. 3,114,401 discloses a multiple tool hand device wherein four different shaped drive bits are useable through interchangeable positions. U.S. Pat. No. 5,904,080 discloses the use of a hand tool wherein up to eight different drive bits are useable through interchangeable positions.

U.S. Pat. No. 2,641,478 discloses screw drivers in which the shank of the screw driver cooperates with a handle member in a manner to reverse the shank to make different screw driver bits available.

U.S. Pat. No. 3,187,610 discloses a manually operable tool pertaining to a multiple socket wrench.

Another objective of the invention is to provide a multipurpose drive tool capable of storing at least six drive bits with each drive bit having a first and second drive end selected from the group consisting of: Phillips® cross-head, blade head, hex head, and Torx® six pointed drive head, or the like, allowing various combinations and sizes.

U.S. Pat. No. 4,448,097 discloses a driver tool utilizing a sleeve which fits within and rotates with an elongated shaft. Driving bits are held to the sleeve and turned by the action of the rotating shaft. A handle, which is expandable, connects to the elongated shaft.

U.S. Pat. No. 5,450,775 discloses a multi-function tool that includes a handle having first and second ends, with the first end having an opening for receiving a screwdriver tip, and the second end having an opening for receiving a tube which is releasably retained in relation to the handle by a collet.

U.S. Pat. No. 5,904,080 discloses a hand tool to torque a fastener by means of at least one hexagonal cavity in an outer reversible coupling member, and a pair of inner, hexagonal shaped, reversible coupling members having differently sized hexagonal cavities than that of said at least one hexagonal cavity of said outer reversible coupling member; the inner, hexagonal shaped reversible coupling members being removably retained in the at least one hexagonal cavity of said outer coupling member, and a handle having cavity means of a size and shape for removably retaining the outer reversible coupling member, and for driving another differently sized hexagonal fastener; whereby the hand tool is capable of driving differently sized hexagonal fasteners depending upon at least the hexagonal cavities of the outer reversible coupling member and the inner, hexagonal shaped reversible coupling members.

Other patents of general interest include U.S. Pat. No. 19,901 to Aiken; U.S. Pat. No. 438,150 to Glover; U.S. Pat. No. 463,507 to Goodell; U.S. Pat. No. 2,158,728 to Peters; U.S. Pat. Nos. 2,476,762 and 2,596,594 to Petre; U.S. Pat. No. 2,527,492 to Cleary; U.S. Pat. No. 2,635,661 to Egan; U.S. Pat. No. 2,759,734 to Velepec; U.S. Pat. No. 3,426,813 to Robertson; U.S. Pat. No. 3,455,355 to McLogan; U.S. Pat. No. 4,043,230 to Scrivens; U.S. Pat. No. 4,278,119 to Elmore; U.S. Pat. No. 4,404,874 to Lieser; U.S. Pat. No. 4,552,043 to Corona; U.S. Pat. No. 4,776,246 to Elliston; U.S. Pat. No. 4,779,493 to White; U.S. Pat. No. 4,846,042 to Wetty; U.S. Pat. No. 4,924,733 to McKenzie; U.S. Pat. No. 5,174,178 to Disston; U.S. Pat. No. 5,228,363 to Corona; U.S. Pat. No. 5,265,504 to Fruhm; U.S. Pat. No. 5,337,637 to Bih-Lien; U.S. Pat. No. 8,047,102 to Gnatz; and U.S. Pat. No. 9,943,947 issued to Tseng.

Disclosed is an improved multipurpose tool that reduces the amount of molds required, employs a lockable telescoping bit driver and a handle, wherein bit drivers are secured with a biasing spring.

SUMMARY OF THE INVENTION

A multipurpose drive tool formed from a handle having a two piece body with a plurality of storage receptacles formed along an outer surface of the body. In a preferred embodiment, the storage receptacles retain up to six double-end driver bits providing twelve different driver configurations. Biasing springs are used to frictionally engage the driver bits while in a storage position, the springs allow the driver bits to be slid in or removed from a side entry, or in-line with the storage receptacles. The handle includes an inner base member for securing the biasing springs and a spring loaded extension driver to provide a fixed extension position. The extension driver has a first socket formed on a proximal end and a second socket formed on a distal end. The extension driver is slidable through an aperture extending through the handle having a socket on either end, and telescoping between a first extended position to allow access to a first end socket, and a first retracted position to allow access to the proximal end socket. A pin on the extension driver operates in combination with a spring loaded coupling, allowing the extension driver to lock in an extended position.

An objective of the invention is to provide an improved multipurpose tool wherein base members are captured within two handle halves, the base members consist of duplicate parts to reduce mold costs, inventory, and ease assembly; similarly, handle members consist of duplicate parts to reduce mold costs, inventory, and ease of assembly. An extension driver may be locked in an extended position.

Another objective of the instant invention is to provide a multipurpose tool that provides the four most common shaped sockets, namely 7/16", 3/8", 5/16", and 1/4", and stores up to six driver bits, wherein a different type of driver tip is formed on each end of the driver bit.

Still another objective of the invention is to provide a multipurpose drive tool having a handle with spring biased receptacles constructed and arranged to store driver bits in an ergonomically shaped housing, with the receptacles formed along an outer surface of the body providing a friction enhanced handle gripping surface.

Another objective of the invention is to provide a multipurpose drive tool capable of storing at least six drive bits with each drive bit having a first and second drive end selected from the group consisting of: Phillips® head, blade head, hex head, and Torx® drive head, or the like, allowing various combinations and sizes.

Yet another objective of the invention is to provide a multipurpose drive tool having at least one socket that is magnetized for ease of securing metal fasteners.

Still another objective of the invention is to provide a multipurpose drive tool having a lockable extension driver for positioning of a drive bit.

Yet another objective of the invention is to provide a multipurpose drive tool having ball bearings to provide a positive placement and tactile indication of the extension driver positioning.

Yet another objective of the invention is to provide a multipurpose drive tool having ring members to provide a positive coupling of two mirror image halves that form the handle to secure the handle in position and reinforce an area around the inner shaft sockets to allow higher turning torque to be applied to the sockets.

Still another objective of the invention is to lower the cost of manufacturing using a bifurcated handle with each half of the handle forming a mirror of the other, and a bifurcated base member with each half of the base member forming a mirror of the other.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
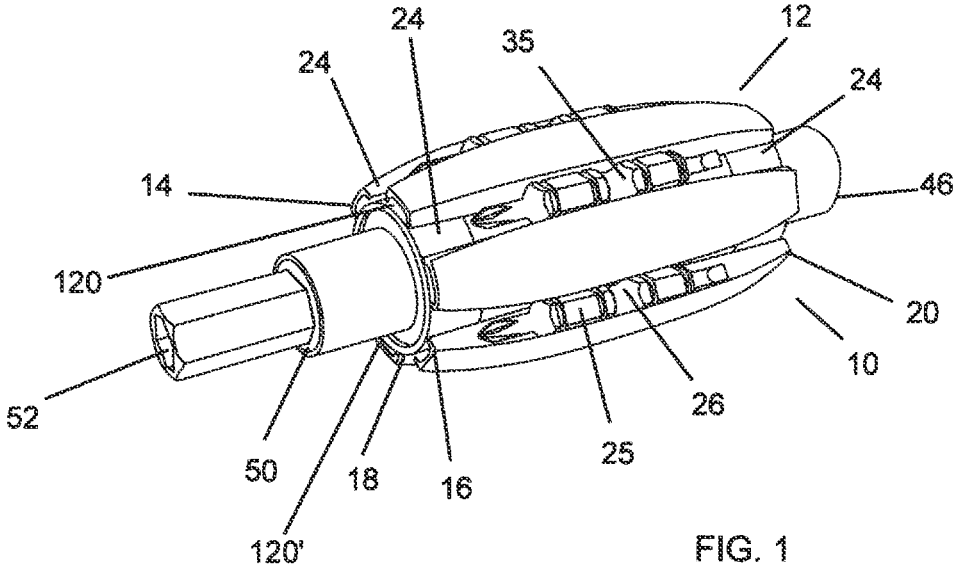
FIG. 1 is a front perspective view of the multipurpose drive tool illustrating extension of a 5/16 inch driver socket through a 7/16 inch driver socket.
Figure 2:
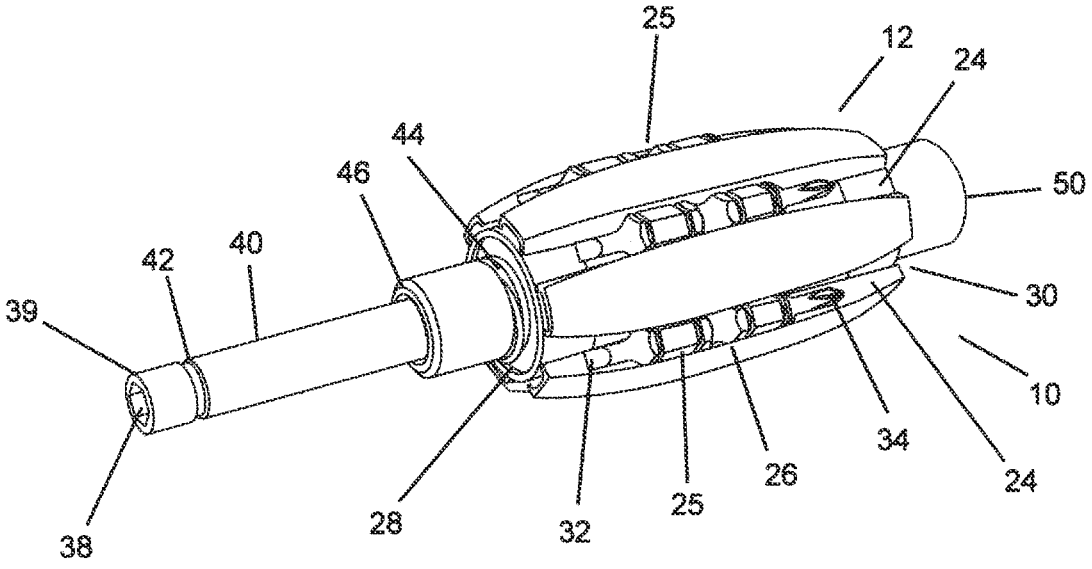
FIG. 2 is a rear perspective view of the multipurpose drive tool illustrating extension of a 1/4 inch driver socket through a 3/8 inch driver socket.

Referring to FIGS. 1 and 2, illustrated is the multipurpose drive tool 10 of the instant invention. The drive tool 10 is generally defined by a handle section 12 formed from two adjoining half members 14 and 16 having a length extending from a first end 18 to a second end 20. The first half member 14 forms a mirror image of the second half member 16, wherein single mold may be used to form each said half member 14, 16 and, when coupled together, form the handle section 12. Each half member 14, 16 include a plurality of evenly spaced receptacles 24 extending between the first end 18 and the second end 20. In a preferred embodiment, there are six receptacles 24 positioned around the perimeter of the handle section 12. Bach receptacle 24 is constructed and arranged to receive a drive bit 25 that is held in the receptacle 24 by a biasing spring strip 26. The biasing spring strip 26 allows the drive bits 25 to be slid into the receptacle 24 from the first end 18, the second end 20, or perpendicular thereto. Similarly, the drive bits 25 can be removed from the receptacles 24 by sliding the bits out of the receptacle toward the first end 18, the second end 20, or pulled out perpendicular thereto. In a preferred embodiment, the drive bit 25 has a first end 32 with a first drive and a second end 34 with a second drive; providing twelve different drive tips. The drive tips may be a Phillips® cross-head, blade head, hex head, hexalobular internal drive head, or the like, allowing various combinations and sizes. A concave center area 35 of each drive bit 25 is shaped to engage a portion of the biasing spring 26, allowing secure retention of the drive bit 25 in the receptacle 24 and providing a tactile feel for removal or positioning. The drive bits 25 are conventionally sized, having 1/4 inch hex shanks.

The drive shanks are operatively associated with an extension driver 40 having a 1/4 inch socket 38 formed at a first end 39 of the extension driver 40 and a 5/16 inch socket formed along a second end 50 of the extension driver.

When the extension driver 40 is in an extended position, the 1/4 inch socket 38 extends outwardly from the handle section 12 for receipt of the appropriate drive bit 25. While the extension driver 40 is extended, the opposite end of the handle section 12 is a 7/16 inch socket 50.

Figure 3:
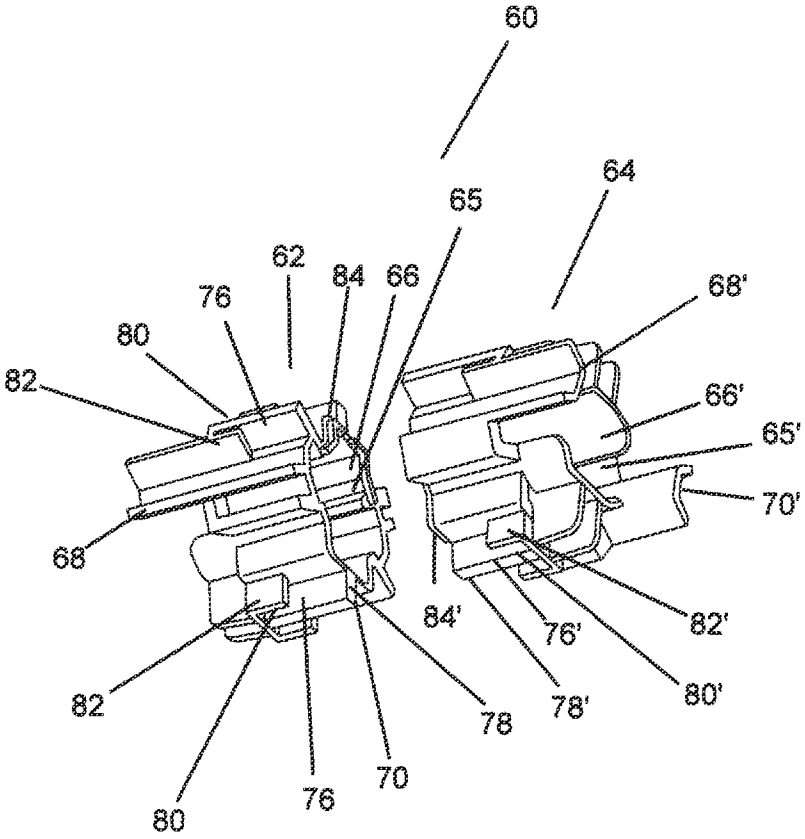
FIG. 3 is an exploded view of the spring base members.
Figure 4:
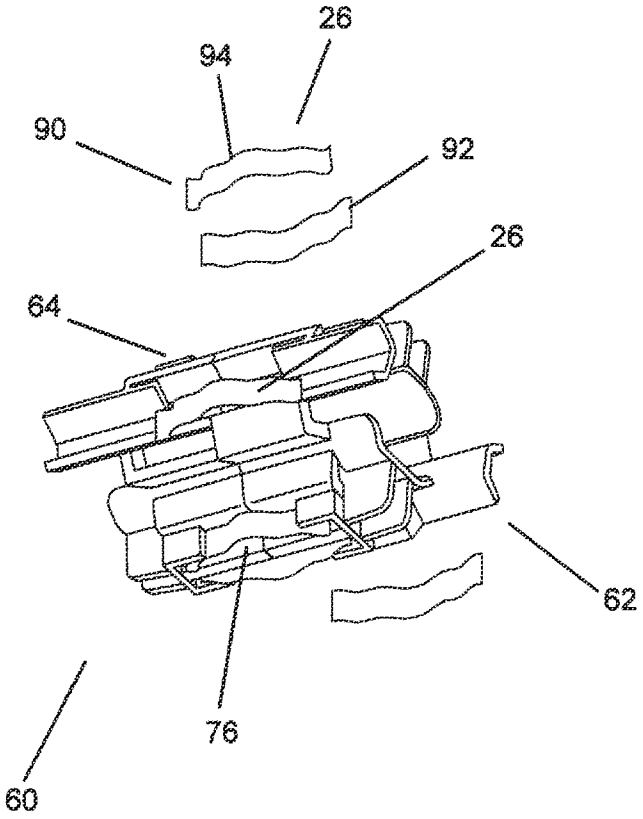
FIG. 4 is a perspective view of the spring base members with biasing springs.
Figure 5:
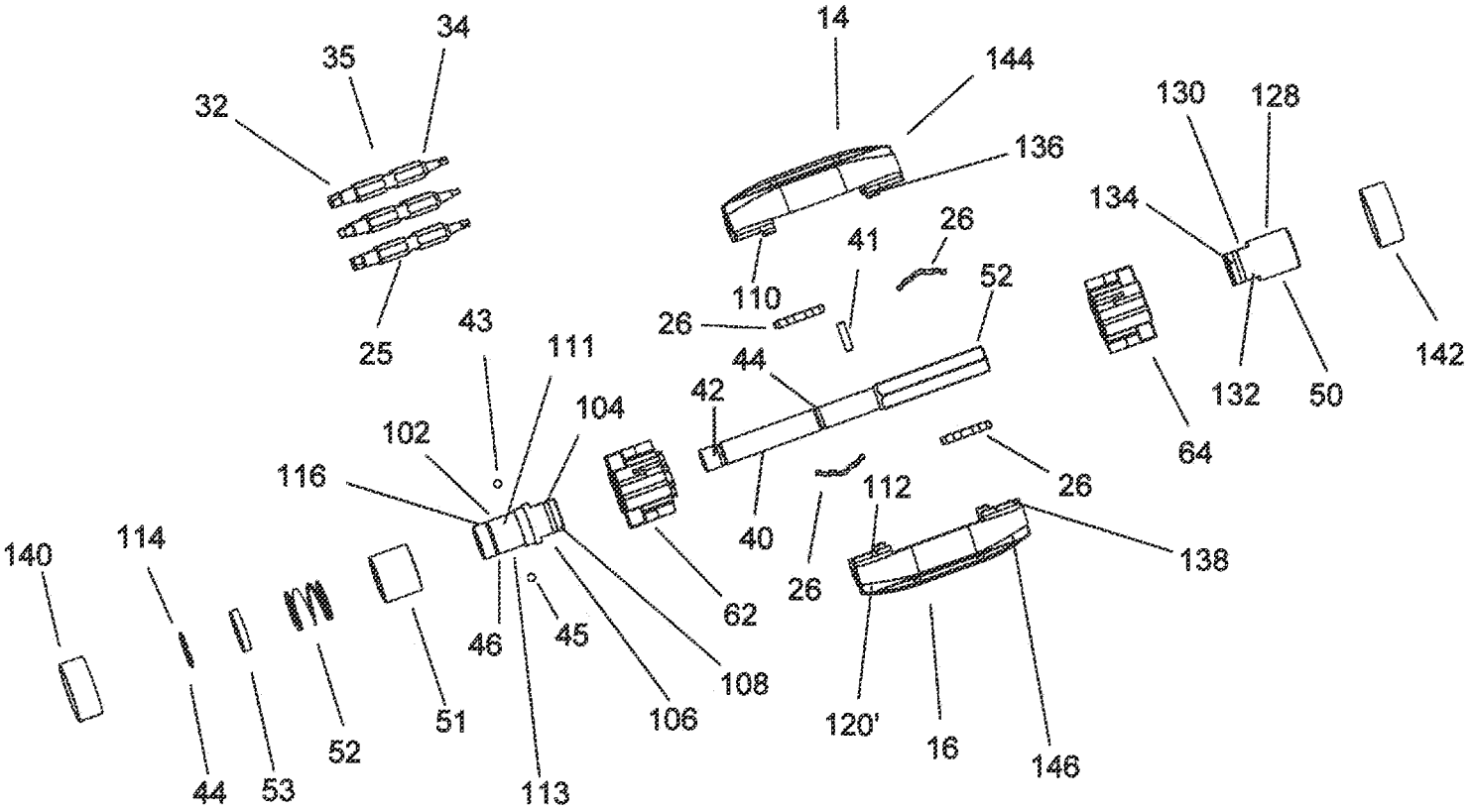
FIG. 5 is an exploded view of the multipurpose drive tool.

Referring to FIGS. 3-5, a spring base 60 consisting of a first spring base member 62 and a second spring base member 64 is illustrated; the first spring base member 62 forming a mirror image of second spring base member 64. The first spring base member 62 includes a centrally disposed tab 84' which interfaces with opening 66, similarly tab 84 interfaces with opening 66'. The centrally disposed aperture 66, 66' with first and second engagement tabs 68', 68' form receptacles 76 and 76'. As previously stated, first half member 14 and second half member 16 form mirror images; for ease of clarity it is understood that the elements applied to handle first member 14 apply to handle second member 16, and elements applied to the first spring base member 62 apply to the second spring base member 64. First spring base member 62 includes one leg of a spring receptacle 76 having a center wall 78, an end wall 80, and an inner wall 82; second spring base member 64 includes one leg of a spring receptacle 76' having a center wall 78', an end wall 80', and an inner wall 82' which, when the first halve and second halve are adjoined, form the spring receptacle 76, 76'. The spring base member 62 includes an alignment lip 84 to engage the spring base member 64. In this embodiment, there are six spring receptacles 76 for receipt of biasing spring strips 26. Each spring strip 26 has a first end 90, a second end 92, and a bowed central section 94. A lip 65 is formed in the first spring base member 62, which is operatively associated with the pin 41 attached to the extension driver 40. The pin 41 is mounted traverse to the extension driver 40 extending from both sides. The second spring base member 64 has a lip 65' that is available for use if the spring base members 62, 64 are reversed; the lip 65 engaging the pin 41 to hold the extension driver 40 in an extended position when a drive bit 25 is in use.

The first spring member 62 receives a ⅜ inch socket 46 having a cylindrical body 102 along one end and opposing flat surfaces 104 and 106 on the opposite end. An engagement groove 108 receives an upper tab 110 from first half member 14 and a lower tab 112 from second half member 16. The upper and lower tabs 110, 112 secure the socket 46 in between when the first and second half members 14, 16 are assembled. The cylindrical body includes opposing apertures 111, 113 for receipt of bearing 43 and 45. The bearings 43, 45 are biased against the extension driver 40 by use of a spring member 52 with a spring sleeve 51. The ball bearings are operatively associated with at least one groove 42 or 44 formed on the shank of the extension shaft 40. The ball bearings 43, 45 provide a tactile indication of said extension driver position.

The spring sleeve 51 and spring member 52 are held in place by a sleeve blocker 53. A c-clip 44 is placed along the outer surface 114 of the sleeve blocker 53 to maintain the spring member 52 in a biased position; the c-clip 44 is placed in the clip groove 116 formed in the outer surface of the cylindrical body 102. The spring member 52 allows the bearings 43, 45 to engage either groove 42 or 44 of the extension driver 40 to provide a tactile feel of engaging either the extended or retracted position. In addition, the spring member 52 requires the extension shaft 40 to be pushed and rotated to be moved from upper and lower tabs 110 and 112, wherein the extension driver 40 may be placed in a locked extended position or an unlocked retracted position. When the half members 14, 16 are coupled together, a first band member 140 is positioned in a receptacle 120, 120' formed on an end of the half members 14 and 16. The 7⁄16 inch socket 50 includes a circular section 128 and a section having a flat upper surface 130 and a flat lower surface 132. A groove 134 is constructed and arranged to secure to a flat section having a tab 136 on the first half member 14 and a flat section having a tab 138 on the second half member 16; the socket 50 being secured to the first and second half member 14, 16 in a similar manner as socket 46 and a ring member 142, wherein ring member 142 is positioned in a receptacle 144, 146 formed on an opposite end of the half member 14 and 16. The ring members 140 and 150 can be permanently fastened to the half member with adhesive.

The four socket sizes depicted in the preferred embodiment, ¼", 5⁄16", ⅜" and 7⁄16", are the most common sized sockets. It is within the scope of this invention to substitute socket sizes including metric adaptation. The ¼" socket is a universally accepted socket size for holding of driver bits. In a preferred embodiment, the extension driver 40 is magnetized to hold steel driver bits when inserted. Similarly, all end socket shaped receptacles can be magnetized to help in installation and removal of metal nuts and bolts. The multipurpose drive tool 10 has an overall length of about 4.5" and weighs about 5 ounces. The handle members 14, 16 and base members 62, 64 are preferably constructed from plastic.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements.

What is claimed is:

1. A multipurpose tool comprising, an extension driver formed from a shank having an external shape with a first end and second end forming a length therebetween, said first end having an inner surface forming a first driver socket, said second end having an inner surface forming a second driver socket;

a spring base member formed from two mirror image halves, said spring base member slidably positioned along the length of said extension driver for positioning said extension driver in a retracted position or an extended position;

a plurality of biasing spring strips secured to said spring base member;

a handle formed from two mirror image half members positioned over said spring base member with a plurality of receptacles formed along an outer circumference, each said receptacle including an aperture allowing a portion of a biasing spring strip of the plurality of biasing spring strips to protrude therethrough;

a first fastener socket having a circular shape with a flat upper surface and a flat lower surface secured to a first end of said handle;

a second fastener socket having a circular shape with a flat upper surface and a flat lower surface secured to a second end of said handle, said extension driver constructed and arranged to slide within said first and said second fastener socket wherein said extension driver may be moved between the retracted position and the extended position; and a plurality of driver bits having a shank positionable within each said receptacle formed on the outer surface of said handle and secured thereto by said biasing spring, and positionable in said first driver socket of said extension driver;

whereby placement of said extension driver in the extended position allows receipt of a driver bit or access to said sockets when said extension driver is in the retracted position.

2. The multipurpose tool according to claim 1 including a pin traversely secured to said extension driver, said pin operatively associated with said base member for securing said extension driver in either the retracted position or the extended position.

3. The multipurpose tool according to claim 1 wherein said first fastener socket includes a biasing spring, wherein said first fastener socket is constructed and arranged to secure said extension driver in the extended position or in the retracted position.

4. The multipurpose tool according to claim 3 wherein said first fastener socket includes at least one socket aperture for receipt of a ball bearing secured in place by said biasing spring, said ball bearing operatively associated with at least one groove formed on said shank, wherein said ball bearing provides a tactile indication of said extension driver in the retracted position or the extended position.

5. The multipurpose tool according to claim 1 wherein said extension driver first end has a ¼" hex shape and second end has a 5/16" hex shape.

6. The multipurpose tool according to claim 1 wherein said first fastener socket is a ⅜" hex shape and said second fastener socket is a 7/16" hex shape.

7. The multipurpose tool according to claim 1 wherein said extension driver first end is sized to receive one of said multipurpose bits.

8. The multipurpose tool according to claim 1 wherein at least said first fastener socket is magnetized.

9. The multipurpose tool according to claim 1 wherein at least one driver bit is magnetized.

10. The multipurpose tool according to claim 1 wherein each said drive bit includes a driver tip selected from the group consisting of: cross-head, blade head, hex head, or hexalobular internal head.

11. A multipurpose cool comprising;

an extension driver formed from a shank having an external shape with a first end and a second and forming a length with a pin extending traversely, said first end having an inner surface forming a first driver socket, said second end having an inner surface forming a second driver socket;

a spring base member formed from two mirror image halves, said spring base member slidably positioned along the length of said extension driver and operatively associated with said pin for positioning said extension driver in a retracted position or an extended position;

plurality of biasing spring strips secured to said spring base member;

a handle formed from two mirror image half members positioned over said spring base member with a plurality of receptacles formed along an outer circumference, each said receptacle including an aperture allowing a portion of a biasing spring strip of the plurality of biasing spring strips to protrude therethrough;

a first fastener socket having a circular shape with a flat upper surface and a flat lower surface secured to a first end of said handle, said first fastener socket includes a socket biasing spring wherein said first fastener socket is rotated from a locked position, securing said extension driver in the extended position to an unlocked position to secure said extension driver in the retracted position;

a second fastener socket having a circular shape with a flat upper surface and a flat lower surface secured to a second end of said handle, and extension driver constructed and arranged to slide within said first and said second fastener socket wherein said extension driver may be moved between the retracted position and the extended position; and a plurality of driver bits having a shank positionable within each said receptacle formed on the outer surface of said handle and secured thereto by said biasing spring strips, and positionable in said first driver socket of said extension driver;

whereby said first fastener socket is constructed and arranged to secure said extension driver in the extended position or retracted position.

12. The multipurpose tool according to claim 11 wherein said first fastener socket includes at least one socket aperture for receipt of a ball bearing secured in place by said biasing spring, said ball bearing operatively associated with at least one groove formed on said shank, wherein said ball bearing provides a tactile indication of said extension driver in the retracted position or the extended position.

13. The multipurpose tool according to claim 11 wherein said extension driver first end has a ¼" hex shape and a second end has a 5/16" hex shape.

14. The multipurpose tool according to claim 11 wherein said first fastener socket is a ⅜" hex shape and said second fastener socket is a 7/16" hex shape.

15. The multipurpose tool according to claim 11 wherein said extension driver first end is sized to receive one of said multipurpose bits.

16. The multipurpose tool according to claim 11 wherein at least said first fastener socket is magnetized.

17. The multipurpose tool according to claim 11 wherein at least one driver bit is magnetized.

18. The multipurpose tool according claim 11 wherein each said drive bit includes a driver tip selected from the group consisting of; cross-head, blade head, hex head, or hexalobular internal head.

* * * * *